United States Patent [19]

Kume et al.

[11] Patent Number: 4,682,965

[45] Date of Patent: Jul. 28, 1987

[54] METHOD FOR MANUFACTURING AN ELECTRON BEAM SELECTION ELECTRODE

[75] Inventors: Hisao Kume, Aichi; Tokihiro Nishihara, Chiba, both of Japan; Hiroharu Shirasaka, San Diego, Calif.; Kenichi Kanehira, Tokyo; Koji Saita, Kanagawa, both of Japan

[73] Assignee: Sony Corporation, Tokyo, Japan

[21] Appl. No.: 678,038

[22] Filed: Dec. 4, 1984

[30] Foreign Application Priority Data

Dec. 8, 1983 [JP] Japan ..... 58-232064

[51] Int. Cl.[4] ..... H01J 9/16

[52] U.S. Cl. ..... 445/37; 219/56.22

[58] Field of Search ..... 313/269; 219/56.22, 219/58; 445/37

[56] References Cited

U.S. PATENT DOCUMENTS

| | | | |
|---|---|---|---|
| 2,279,451 | 4/1942 | English et al. | 219/56.22 X |
| 3,638,063 | 1/1972 | Tachikawa et al. | 313/269 X |
| 4,020,315 | 4/1977 | Euler | 219/56.22 |

*Primary Examiner*—Kenneth J. Ramsey

*Attorney, Agent, or Firm*—Hill, Van Santen, Steadman & Simpson

[57] ABSTRACT

A method of manufacturing, and the structure of an improved electron beam selection electrode of a color cathode ray tube having a pair of arm members with a plurality of grid elements attached thereto and extended therebetween, and a pair of supporting members for the pair of arm members. The method comprises the steps of arranging a damper wire of predetermined length between a pair of fixing members, covering each end of the damper wire arranged on each end of the pair of fixing members with a pair of thin film tapes, respectively, welding both of the damper wire and the thin film tapes thereon to each one end of the pair of fixing members to provide a damper assembly, arranging a wire portion of the damper assembly over a surface of the plurality of the grid elements, and fixing each of the other end of the pair of fixing members to each of the pair of supporting members so as to suppress mechanical vibration of the grid elements.

6 Claims, 5 Drawing Figures

METHOD FOR MANUFACTURING AN ELECTRON BEAM SELECTION ELECTRODE

BACKGROUND OF THE INVENTION

This invention relates to a method of manufacturing an electron beam selection electrode, in particular, an aperture grille of a color cathode ray tube.

An aperture grille which is a kind of electron beam selection electrode is formed by laying grid elements on a frame with a predetermined space provided therebetween. Structure of this type of grille is disclosed in Tachikawa et al U.S. Pat. No. 3,638,063. In such an aperture grille a damper wire is provided for preventing vibration and is stretched on a surface of the grid elements laid on the frame. Conventionally, stretching of the damper wire has been only manually carried out, and the following problems have been present. That is, since the damper wire is fine, such that the diameter thereof is 15–30 μm, it is difficult to accurately position the damper wire to a fixing member (so-called spring member) fixed on the frame and weld same thereto. Further, as shown in FIG. 1, upon positioning the damper wire 1 on the fixing member 2 and welding same by an upper electrode 3 and a lower electrode 4 (see FIG. 1A), the damper wire 1 itself is not molten, but the upper electrode 3 as well as the fixing member 2 are molten to cause deformation of both the electrodes because material of the damper wire 1 is tungsten (See FIG. 1B). When a subsequent damper wire 1 is welded using such electrodes 3 and 4 as thus deformed, welding uniformity is greatly deteriorated. Accordingly, the prior method has generated a color cathode ray tube in which there is a possibility of improper beam landing because of inaccuracies in installation of the damper wire 1.

SUMMARY OF THE INVENTION

It is an object of the present invention to solve the above-mentioned problems that have occurred with the conventional method of manufacturing a color cathode ray tube, and to provide a method of manufacturing a color cathode ray tube which enables the damper wire to be easily, accurately, and securely stretched on the aperture grille.

The present invention is a method of manufacturing an electron beam selection electrode of a color cathode ray tube which includes a pair of frame arm members with a plurality of grid elements attached thereto and extended therebetween, and a pair of supporting members for fixedly positioning the pair of arm members, comprising the steps of arranging a damper wire of predetermined length between a pair of fixing members, covering each end of the damper wire arranged on each of the pair of fixing members with a thin film tape, welding both the damper wire and the thin film tape thereon to one end of each of the pair of fixing members to provide a damper assembly, arranging the wire portion of the damper assembly over a surface of the plurality of grid elements, and fixing the other end of each of the pair of fixing members to a respective supporting member so as to suppress mechanical vibration of the grid elements.

According to the present invention, it is possible to automate installation of the damper wire to the aperture grille, and largely improve productivity of the aperture grille. As the aperture grille obtained by the present invention includes the damper wire accurately stretched thereon, a color cathode ray tube using this aperture grille may eliminate defects such a mislanding as has occurred in the prior art.

The above and other objects, features and advantages of the present invention will become readily apparent from considering the following detailed description in conjunction with the accompanying drawings.

DETAILED DESCRIPTION OF THE PREFERRED EMBODIMENT

Figure 1A:
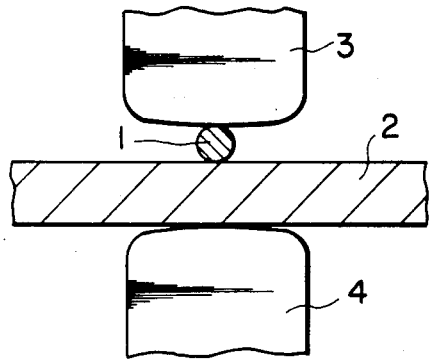
FIGS. 1A to 1C are sectional views showing a conventional method of welding a damper wire to a fixing member.
Figure 1B:
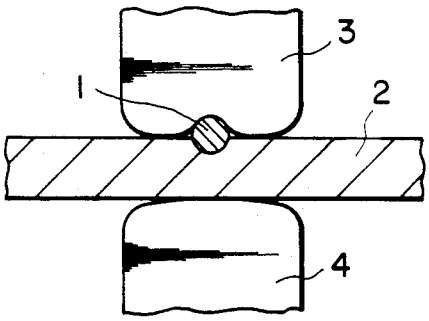
Figure 1C:
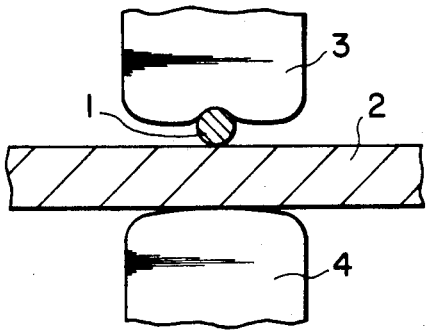
Figure 2A:
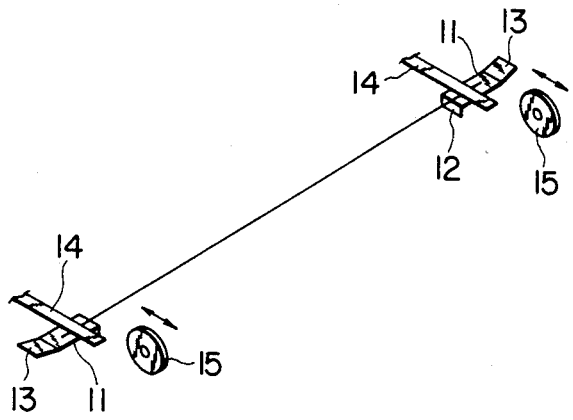
FIGS. 2A and 2B are illustrative views showing a process for installing a damper wire to an aperture grille according to the present invention.
Figure 2B:
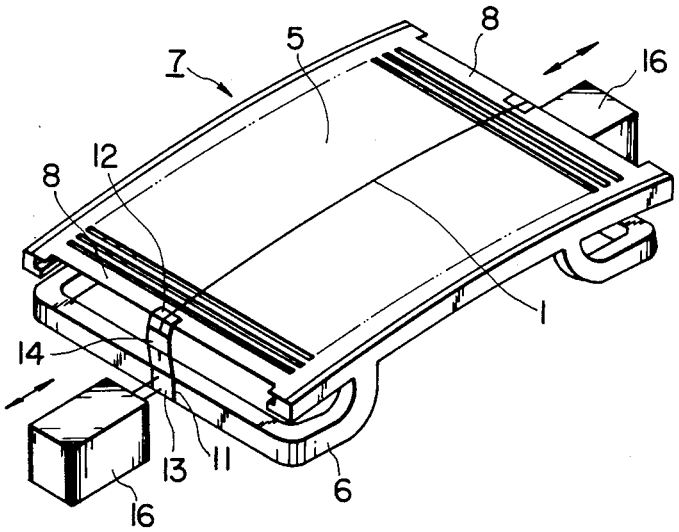

As an electron beam selection electrode according to the present invention, a so-called aperture grille including grid elements laid on a frame is used as shown in FIG. 2B.

Referring to FIG. 2A, a pair of fixing members 11 are each formed of a spring element. Portions 12 to be engaged with end portions 8 of grid elements 5 are bent to L-shape, and portions 13 to be fixed to a frame 6 are slightly bent in a reverse direction of the L-shaped portions 12. Then, the pair of fixing members 11 are arranged at positions corresponding to length of a damper wire 1 to be stretched on the grid elements 5. After the damper wire 1 of tungsten is stretched between the pair of fixing members 11, a pair of thin film tapes 14 of stainless steel are placed on the damper wire 1 on the fixing members 11, and the damper wire 1 is seam welded to the fixing members 11 through the thin film tapes 14 by an amount of 5–6 mm by means of a pair of roller electrodes 15 driven in a direction perpendicular to the damper wire 1 as shown in FIG. 2(A). Thickness of the thin film tapes 14 may be about 70 μm, for example. After seam welding, unnecessary portions of the thin film tapes 14 are trimmed off. Then, as shown in FIG. 2B, both the fixing members 11 with the damper wire 1 secured thereto are placed on the surface of the grid elements 5 of the aperture grille 7, and the L-shaped portions 12 of the fixing members 11 are engaged with the end portions 8 of the grid elements 5. Thereafter, the portions 13 of the fixing members 11 are simultaneously fixed to the frame 6 by spot welding with a spot welding machine 16. After welding, the engagement of the L-shaped portions 12 of the fixing members 11 with the end portions 8 of the grid elements 5 is released. And the L-shaped portions 12 of the fixing members 11 are moved outwardly away from the end portions 8 in a parallel direction to a surface of the grid elements 5. Accordingly the damper wire 1 is easily and securely stretched on the aperture grille. Although the damper wire 1 is single in the preferred embodiment, two or more damper wires may be provided as desired.

As above described, since the damper wire 1 is welded through the thin film tapes 14 to the fixing members 11, there is no possibility of faulty embedding of the damper wire 1 into the fixing members 11 as in the prior art. Further, as the above-mentioned welding is carried out with use of roller type electrodes 15, there is no possibility that a particular portion of the electrodes 15 is significantly deformed. Accordingly, it is possible to easily and surely carry out stretching of the damper wire 1 between both the fixing members 11 and fixing of both the fixing members 11 to the frame 6. Further, as the L-shaped portions 12 are engaged with the end portions 8 of the grid elements 5, the fixing members 11 may be accurately positioned with respect to a direction (Z direction) perpendicular to a surface of the grid elements 5. Accordingly, it is possible to eliminate displacement of the grid elements 5 due to the damper wire 1 upon installation of the damper wire 1, thereby eliminating mislanding due to stretching of the damper wire 1.

Numerous modifications and variations of the disclosed invention will become apparent to those skilled in the art without departing from the scope and spirit of the invention as defined in the attached claims.

We claim as our invention:

1. A method for manufacturing an electron beam selection electrode for a color cathode ray tube, said electrode having a pair of spaced arm members, a plurality of grid elements respectively attached to and extending between said arm members, a pair of spaced end members parallel to said grid elements also extending between said arm members, a pair of support elements respectively disposed below and spaced from each end member, and a damper wire, said method comprising the steps of:

arranging a damper wire of predetermined length between a pair of spaced fixing members with opposite ends of said damper wire extending over a first end of each of said fixing members;

covering each opposite end of said damper wire and each first end of said fixing members with respective thin film tapes;

welding each of said ends of said damper wire and said thin film tapes respectively to said first ends of said fixing elements to provide a damper assembly;

arranging the wire of said damper assembly over said grid elements by engaging a portion of said first ends of said fixing elements respectively with said end members and with a second opposite end of each of said fixing members extending downwardly to one of said support members;

rigidly attaching said second ends of said fixing members respectively to said support elements; and disengaging the first ends of said fixing elements from said respective end members thereby tensioning said damper wire across said grid elements to suppress mechanical vibration of said grid elements.

2. The method according to claim 1, in which each of said pair of fixing members is a resilient spring and wherein the step of rigidly attaching said second ends of said fixing members is further defined by attaching each of the fixing members to its respective supporting member under a tension of said wire.

3. The method according to claim 1, in which said welding step is further defined by welding by means of a roller electrode.

4. The method according to claim 1, comprising the additional step of bending the first end of each of said fixing members to an L-shape at portions to be engaged with said end portions of said grid elements and wherein the step of arranging the wire of said damper assembly over said grid elements is further defined by slidably engaging the foot of each L with its associated end portion.

5. The method according to claim 1, wherein the step of covering with thin film tapes is further defined by covering each opposite end of said damper wire and each first end of said fixing members with respective thin film tapes made of stainless steel.

6. The method according to claim 1, wherein the step of welding is further defined by welding by means of spot welding.

* * * * *